US008728692B2

(12) United States Patent
Nair et al.

(10) Patent No.: US 8,728,692 B2
(45) Date of Patent: May 20, 2014

(54) SURFACE DECORATED PARTICLES

(75) Inventors: Mridula Nair, Penfield, NY (US); David D. Putnam, Fairport, NY (US); Shari L. Eiff, Rush, NY (US); Cumar Sreekumar, Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 190 days.

(21) Appl. No.: 12/847,196

(22) Filed: Jul. 30, 2010

(65) Prior Publication Data

US 2012/0028181 A1 Feb. 2, 2012

(51) Int. Cl.
*G03G 9/00* (2006.01)

(52) U.S. Cl.
USPC ..... 430/108.6; 430/108.1; 430/108.7

(58) Field of Classification Search
USPC ..... 430/108.1, 108.6, 108.7
See application file for complete search history.

(56) References Cited

U.S. PATENT DOCUMENTS

| | | | | |
|---|---|---|---|---|
| 4,740,443 | A * | 4/1988 | Nakahara et al. | 430/108.24 |
| 4,833,060 | A | 5/1989 | Nair et al. | |
| 4,965,131 | A | 10/1990 | Nair et al. | |
| 5,198,320 | A | 3/1993 | Vreeland et al. | |
| 5,376,172 | A * | 12/1994 | Tripp et al. | 106/490 |
| 6,210,851 | B1 | 4/2001 | Srinivasan et al. | |
| 6,214,511 | B1 * | 4/2001 | Akazawa et al. | 430/108.7 |
| 6,544,705 | B2 | 4/2003 | Kim et al. | |
| 6,682,866 | B2 | 1/2004 | Sugiyama et al. | |
| 6,800,412 | B2 | 10/2004 | Sugiyama et al. | |
| 7,601,473 | B2 | 10/2009 | Lofftus et al. | |
| 2008/0050667 | A1 * | 2/2008 | Lobo et al. | 430/108.1 |
| 2008/0176157 | A1 | 7/2008 | Nair et al. | |
| 2008/0176164 | A1 * | 7/2008 | Nair et al. | 430/137.14 |
| 2008/0268362 | A1 * | 10/2008 | Kudo | 430/108.1 |
| 2012/0028185 | A1 | 2/2012 | Nair et al. | |

FOREIGN PATENT DOCUMENTS

| | | |
|---|---|---|
| WO | 2008/088697 | 7/2008 |
| WO | 2008/088700 | 7/2008 |

OTHER PUBLICATIONS

Robert Aveyard, et al.; "Emulsions stabilized solely by colloidal particles;" Advances in Colloid and Interface Science 100-102 (2003) 503-546.

* cited by examiner

*Primary Examiner* — Stewart Fraser
(74) *Attorney, Agent, or Firm* — Andrew J. Anderson; Raymond L. Owens

(57) ABSTRACT

A surface decorated particle including a core particle phase having an outer surface; and fine inorganic particles on the outer surface of the core particle phase; wherein the fine inorganic particles have hydrophobic groups covalently bonded primarily on portions of surfaces of the fine inorganic particles positioned away from the core particle phase. Such surface decorated particles are obtainable by a method including stabilizing dispersed hydrophobic phase particles in an aqueous phase with fine inorganic particles having a relatively hydrophilic surface; and treating the stabilized dispersed hydrophobic phase particles with a hydrophobic group containing reactant to form hydrophobic groups covalently bonded to surfaces of the fine inorganic particles. In a particular embodiment, such surface decorated particles are obtainable by a limited coalescence process for preparing binder polymer particles using inorganic stabilizer particles that provide a plurality of surface bonding sites and reacting such sites with a plurality of alkoxy silane moieties that contains pendant hydrophobic groups.

14 Claims, 1 Drawing Sheet

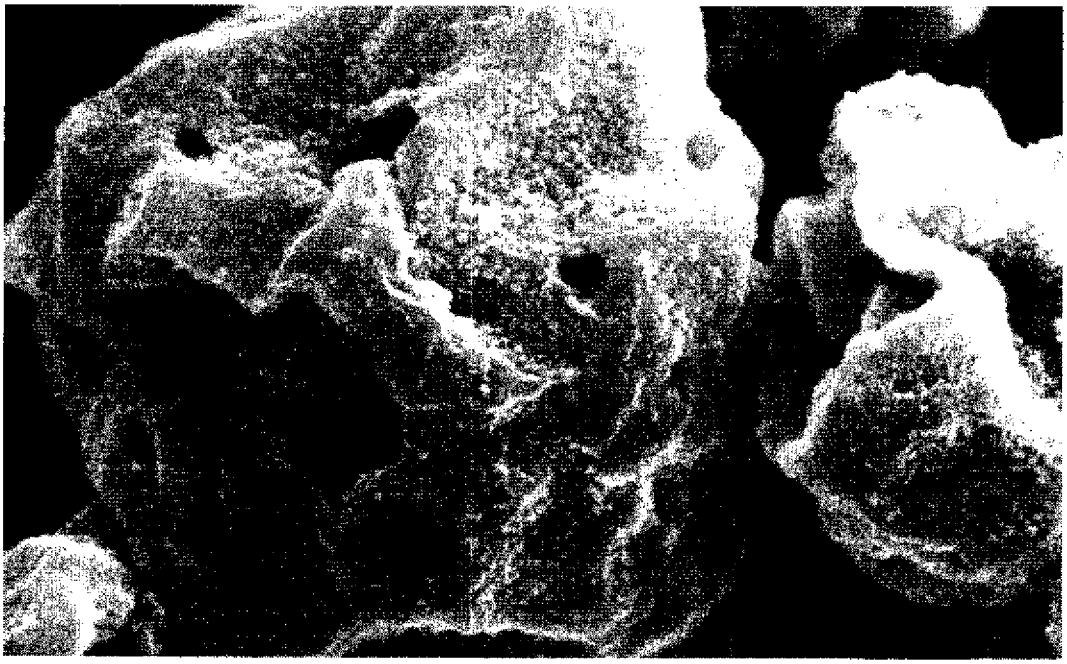

SURFACE DECORATED PARTICLES

CROSS-REFERENCE TO RELATED APPLICATIONS

Cross-reference is made to copending, commonly assigned, concurrently filed U.S application Ser. No. 12/847,185, filed Jul. 30, 2010, directed towards "Method for Forming Surface Decorated Particles", the disclosure of which is incorporated by reference herein.

FIELD OF THE INVENTION

The invention relates generally to the field of surface decorated particles, and in particular to surface decorated core polymer particles. The invention further relates to electrostatographic toner comprising core polymer particles that have a surface layer of small inorganic particles that have hydrophobic groups covalently bonded primarily on portions of surfaces of the fine inorganic particles positioned away from the core particle phase. The invention also pertains to the method of making such polymer particles and electrophotographic toner.

BACKGROUND OF THE INVENTION

In electrostatography an image comprising an electrostatic field pattern, usually of non-uniform strength, (also referred to as an electrostatic latent image) is formed on an insulative surface of an electrostatographic element by any of various methods. For example, the electrostatic latent image may be formed electrophotographically (i.e., by image wise photo-induced dissipation of the strength of portions of an electrostatic field of uniform strength previously formed on a surface of an electrophotographic element comprising a photoconductive layer and an electrically conductive substrate), or it may be formed by dielectric recording (i.e., by direct electrical formation of an electrostatic field pattern on a surface of a dielectric material). Typically, the electrostatic latent image is then developed into a toner image by contacting the latent image with an electrostatographic developer. If desired, the latent image can be transferred to another surface before development.

One well-known type of electrostatographic developer comprises a dry mixture of toner particles and carrier particles. Developers of this type are commonly employed in well-known electrostatogaphic development processes such as cascade development and magnetic brush development. The particles in such developers are formulated such that the toner particles and carrier particles occupy different positions in the triboelectric continuum, so that when they contact each other during mixing to form the developer, they become triboelectrically charged, with the toner particles acquiring a charge of one polarity and the carrier particles acquiring a charge of the opposite polarity. These opposite charges attract each other such that the toner particles cling to the surfaces of the carrier particles. When the developer is brought into contact with the latent electrostatic image, the electrostatic forces of the latent image (sometimes in combination with an additional applied field) attract the toner particles, and the toner particles are pulled away from the carrier particles and become electrostatically attached imagewise to the latent image-bearing surface. The resultant toner image can then be fixed in place on the surface by application of heat or other known methods (depending upon the nature of the surface and of the toner image) or can be transferred to another surface, to which it then can be similarly fixed or again retransferred to another surface upon which it is to be fixed.

Many well-known types of toner useful in dry developers comprise binder polymer materials such as vinyl addition polymers or condensation polymers. Such binder polymers are chosen for their good combinations of advantageous properties, such as toughness, transparency, good adhesion to substrates, and fusing characteristics, such as the ability to be fixed to paper at relatively low fusing temperatures while not permanently adhering to fusing rolls. As is well-known, vinyl addition polymers that are useful as binder polymers in toner particles can be linear, branched or lightly crosslinked. The most widely used condensation polymers are polyesters which are polymers in which backbone recurring units are connected by ester linkages. Like the vinyl addition polymers, polyesters useful as binder materials in toner particles can be linear, branched, or lightly crosslinked. They can be fashioned from any of many different monomers, typically by polycondensation of monomers containing two or more carboxylic acid groups (or derivatives thereof, such as anhydride or ester groups) with monomers containing two or more hydroxy groups.

While many binder polymers exhibit many desirable properties for use in electrostatographic toners, they also may have certain shortcomings. For example, binder polymers are commonly ground to a small particle size to provide the high degree of resolution required in good quality reproductions. Unfortunately, many polymers, and especially polyesters which are otherwise useful for toners, are not sufficiently easily ground to the very small particle sizes needed for high-resolution toners. To overcome this problem, methods have been developed which directly provide binder polymers having a controlled and predetermined size and size distribution suitable for use in electrostatographic toners by chemically prepared processes. One such method is a polymer suspension technique which is known in the prior art as a "limited coalescence" process, as described in U.S. Pat. Nos. 4,833,060, 4,965,131, 6,544,705, 6,682,866, and 6,800,412; incorporated herein by reference for all that they contain.

The preparation of toner polymer powders from a preformed polymer by the chemically prepared toner process such as the "evaporative limited coalescence" (ELC) offers many advantages over the conventional grinding method of producing toner particles. In this process, polymer particles having a narrow size distribution are obtained by forming a solution of a polymer in a solvent that is immiscible with water, dispersing, under suitable shear and mixing conditions, the solution so formed in an aqueous medium containing a fine particulate solid colloidal stabilizer to form stabilized dispersed droplets of the polymer solution, and removing the solvent. Removal of the solvent from the droplets provides solid binder polymer particles that are covered with a layer of smaller stabilizer particles. The resultant polymer particles are typically then isolated, washed and dried.

In the practice of this technique, polymer particles may be prepared from any type of polymer that is soluble in a solvent that is immiscible with water. The size and size distribution of the resulting particles can be predetermined and controlled by the relative quantities of the particular polymer employed, the solvent, the quantity and size of the water insoluble solid particulate suspension stabilizer, typically silica or latex, and the size to which the solvent-polymer droplets are reduced by mechanical flowing and shearing using rotor-stator type colloid mills, high pressure homogenizers, agitation etc. In a related alternative limited coalescence process, dispersed monomers may be polymerized in the presence of the particulate stabilizer to form solid binder polymer particles covered with the stabilizer particles.

US 2008/0176164 and US 2008/0176157 describe porous polymer particles that are made by a multiple emulsion process, that in one phase of the process results in formation of individual porous particles comprising a continuous polymer phase and internal pores containing an internal aqueous phase, where such individual particles are dispersed in an external aqueous phase. The LC process is used to control the particle size and distribution.

Porous toner particles in the electrophotographic process can potentially reduce the toner mass in the image area. Simplistically, a toner particle with 50% porosity should require only half as much mass to accomplish the same imaging results. Hence, toner particles having an elevated porosity will lower the cost per page and decrease the stack height of the print as well. The application of porous toners provides a practical approach to reduce the cost of the print and improve the print quality.

Toner particles made by the ELC or polymerization LC processes, whether porous or nonporous, are typically treated with base at pH 12 or greater to remove the colloidal stabilizers on the surface of the toner particles, when employing colloidal inorganic stabilizers in the preparation of the particles. This is necessary because the silanol end groups from colloidal silica stabilizer particles, e.g., interfere with the triboelectric properties of the carrier and toner particles employed as developers in electrostatographic imaging devices. As a result the surface fine colloidal silica particles are removed under high pH conditions. Such conditions, however, can prove to be costly and detrimental to certain binders that are easily hydrolyzed such as polyesters.

It is desirable to use high strength colorants for use in electrostatographic full process color printing processes that employ a toner set comprising a cyan, a magenta, a yellow and, optionally, a black toner. One such desirable colorant is the isoindoline yellow pigment known by its Color Index designation as Pigment Yellow 185, or PY 185. It confers good tinctorial strength and the required hue for many print applications. A problem with using PY 185 in a typical LC process, however, is that it is sensitive to high pH treatment required for removal of the colloidal stabilizer, and tends to wash out and change hue.

The reduction of attractive forces exerted on a toner enhances processes where the toner particles must move. Some processes that benefit from lower adhesive and cohesive forces are toner powder flow in the replenisher, mixing of toner in the developer station, development of toner onto the latent image, transfer of the image to intermediate and final receivers, and cleaning of residual images from photoconductors and intermediate receivers.

The attractive van der Waals forces between toner particles and other surfaces decrease as $D/s^2$ where D is the toner diameter and s is the separation at the closest point between the toner and the other surface and $s \ll D$. Relatively small separating particles may be added to the surface of toner particles to reduce attractive forces exerted on the toner particles. A few points of contact between the other surface and the toner created by the separating particles increase the separation between the surfaces. The points of contact of separating particles with the toner and another surface add a small attractive force. As such, the ideal situation is for the separating particles to be uniformly dispersed on the toner with a minimum coverage to affect the desired separation given the curvature of the toner and the size of the inorganic particles.

While the stabilizer particles employed in the LC processes are in the submicron range and if left alone on the surface can reduce the attractive forces exerted on the final dry toner, the inorganic stabilizer particles that are typically used in the limited coalescence processes such as silica particles unfortunately interfere with triboelectrification and must be removed from the binder polymer particles that are used in an electrostatographic toner as discussed above.

Consequently, surface forces of toners are typically modified by application of dry surface treatments to dry toner particles where inorganic stabilizer particles employed in the limited coalescence process have already been removed. The most common surface treatments are hydrophobically modified silicas, but fine particles of titanic, alumina, zinc oxide, tin oxide, cerium oxide, and polymer heads can also be used. The fine particles are chemically modified with silanes or polydimethylsiloxane to achieve the desired surface forces and triboelectric function. Varying particle sizes and amounts of surface treatment are used to ensure that the desired separation distance is maintained during violent collisions and shearing motion in toning stations to induce a static charge on the toner, to develop latent images on photoreceptors with toner, to transfer the developed images to intermediate and final receivers, and in other ancillary processes involving toner such as cleaning.

Violent collisions of the toner particle with carrier normal to the surface of the toner direct the impulse force on the surface treatment. The impulse force can exceed the strength of the toner core material (usually a melt adhesive polymer with a glass transition temperature, Tg, in the range of 50 to 60 degrees centigrade). The kinetic energy of the collision is transformed into heat and, because of the short duration of the collision event, the heat is localized at the surface treatment contact points with the toner particle and other surface. The local temperature at the contact briefly exceeds the Tg and the toner core material will plastically deform around the surface treatment increasing the area of contact. Because the separation in this area of contact is on the atomic scale, the attractive forces between the surface treatment and the toner are greatly increased. When this attractive force exceeds the shearing forces applied in the system, the surface treatment is tacked to the toner surface.

Before the fine particles used for surface treatment becomes tacked, shearing motions may move their position on the toner surface. The movement reduces the spacing and may allow contact of the core material of the toner particle with another surface. With sufficient shearing, the surface treatment will be concentrated in low (concave) areas of the toner surface necessitating an initial excess of surface treatment to obtain the desired separation. During gentle collisions and shearing contacts, some of the surface treatment may transfer to other surfaces. This reduces the effectiveness of the surface treatment and may create problems associated with the other surface. For example, transfer of the surface treatment to the carrier surface in a two component system may change the internal coefficient of friction resulting in changes in developer packed density and flow characteristics. Control of packed density of the developer is important because many toner concentration control algorithms rely upon changes in magnetic density as a function of toner concentration to measure the concentration for feedback control. Untacked surface treatment can also transfer to imaging surfaces ultimately accumulating and scumming these surfaces or other subsystems in contact with the imaging surface like roller chargers. Lastly, dry surface treatments have a portion of large agglomerates that if not properly dispersed can cause voids in the image.

There are many devices that have been developed to deagglomerate, disperse, and tack dry surface treatment agents on to the toner surface. Some mechanical devices such as the Cyclomix mixer generate an intense mechanical force by compressive shearing of a packed toner bed between a moving tools and a stationary wall. A high degree of shear rapidly heats the toner increasing the rate of tacking but also displacing some of the surface treatment into the low lying areas of the toner surface reducing the effectiveness of the surface treatment. Other devices such as the Henschel mixer rely upon toner-toner collisions in a fluidized bed to disperse the surface treatment. These collisions produce much lower shear and are more effective in achieving uniform dispersions. However, the normal forces are also lower and tacking is difficult to obtain. Also as the toner mass is decreased through reduced size or increased porosity, the momentum of the particle is reduced leading to excessively long mixing times to achieve the desired firmly attached (tacked) state of the silica on the toner surface. The mixing time varies with toner mass and for toner particles of less than 8 μm can frequently exceed 20 minutes. The effectiveness of such mixers and methods to quantify the degree of surface treatment tacking are described in U.S. Pat. No. 7,601,473.

U.S. Pat. No. 5,198,320 describes toner prepared by a limited coalescence process comprising binder polymer particles that have a surface layer of smaller polymeric stabilizer particles that are covalently bonded through a plurality of oxygen linkages to a polysiloxane oligomer containing pendant charge-agent moieties. The toner formation process involves a multistep process including the preparation of functionally active latex particles to stabilize the droplets in the ELC process and further the preparation of a polyorganosiloxane oligomer to functionalize the reactive groups of the latex. Surface treatment of such toner particles with hydrophobic inorganic spacing particles would need to be performed in a separate step, with the potential problems noted above.

SUMMARY OF THE INVENTION

While processes have been developed to remove inorganic colloidal particles used as limited coalescence stabilizer particles in the formation of polymeric particles and subsequently treat such polymer particles with inorganic particles distinct from the inorganic stabilizer particles, it would be desirable to provide binder polymer particles obtainable by a limited coalescence process with predispersed non-aggregated inorganic fine particles on the surface that are substantially tacked and exhibit adequate surface force and electrostatographic charge-control characteristics. Likewise, it would be desirable to provide electrostatographic toners comprising such core polymer particles.

In particular, it would be desirable to avoid or minimize the lengthy, high pH and generally costly techniques that are normally necessary to remove inorganic stabilizer particles such as silica from the core polymer particles made by the limited coalescence process particularly for use as electrostatographic toners when employing polymer binders or toner colorants that are sensitive to high pH treatment. It is also particularly desirable to avoid or minimize the lengthy and costly manufacturing techniques to disperse and tack dry surface treatments used in electrophotographic toners when employing relatively small size toner particles or porous toner particles.

It would also be desirable to provide toners obtainable by a cost efficient method of surface modification of toners comprising colloidal silica on the surface to improve charging and reduce dusting of the toner such that they can be then be used with minimum further treatment to obtain useful functioning toners.

It is also desirable to provide unique particles with hydrophobic particulate inorganic surface decorations.

These and other objects of the invention are obtained in accordance with various embodiments of the present invention, which provides a surface decorated particle comprising: a core particle phase having an outer surface; and fine inorganic particles on the outer surface of the core particle phase; wherein the fine inorganic particles have hydrophobic groups covalently bonded primarily on portions of surfaces of the fine inorganic particles positioned away from the core particle phase. Such surface decorated particles are obtainable by a method comprising: stabilizing dispersed hydrophobic phase particles in an aqueous phase with fine inorganic particles having a relatively hydrophilic surface; and treating the stabilized dispersed hydrophobic phase particles with a hydrophobic group containing reactant to form hydrophobic groups covalently bonded to surfaces of the fine inorganic particles. In a particular embodiment, such surface decorated particles are obtainable by a limited coalescence process for preparing binder polymer particles using inorganic stabilizer particles that provide a plurality of surface bonding sites and reacting such sites with a plurality of alkoxy silane moities that contains pendant hydrophobic groups.

Other significant embodiments and advantages of this invention will become evident from the description that follows.

BRIEF DESCRIPTION OF THE DRAWINGS

FIG. 1 a scanning electron microscope (SEM) image of surface decorated particles of the present invention obtained in Example 1.

For a better understanding of the present invention together with other advantages and capabilities thereof, reference is made to the following description and appended claims in connection with the preceding drawings.

DETAILED DESCRIPTION OF THE INVENTION

A feature of this invention is the use of small inorganic stabilizer particles (generally colloidal in size) that adhere to the surface of the core particle phase and provide a layer that has active (e.g., hydroxy (—OH)) sites that are capable of reacting with a hydrophobic group containing reactant (e.g., the plurality of alkoxy groups of a hydrophobically functionalized alkoxy silane compound) to provide a hydrophobicity to the inorganic stabilizer particles through covalent bonding. Any inorganic stabilizer particles that are capable of limiting the coalescence of the core particle phase droplets during an LC process and of providing a layer having such active sites can be employed in the practice of this invention. Metal oxide and silica particles, comprising hydrophilic active hydroxyl (—OH) sites on their surfaces, are representative inorganic stabilizer particles that may be employed. A preferred class of stabilizers is colloidal silica such as NALCO 1060 and LUDOX TM.

Considering the stable nature of the interface between the fine inorganic stabilizer particles and the outer surface of the core polymer particle phase particles, it is believed that the stabilizer particles are firmly held or adsorbed on the surface of the core polymer particle phase due to a strong mutual attraction such as hydrogen bonding. Regardless of the exact mechanism involved, such stabilizer particles form a layer on the binder polymer particles which permits hydrophobic moiety containing reactants to be firmly and permanently affixed to such particles. This provides a method that is direct, efficient and cost effective for obtaining core phase particles through a limited coalescence process which are surface decorated with hydrophobic group modified stabilizer particles, and in particular surface treated electrostatographic toners.

A preferred feature of this invention is the use of an organosilane reactant to provide hydrophobic groups (e.g., hydrocarbon groups) covalently bonded to the surfaces of the fine inorganic particles through silicon linking groups. In particular, alkoxy silanes containing pendant hydrophobic groups such as alkyl groups are preferably employed to directly modify the fine inorganic stabilizer particles adhered to the core polymer particle phase. The inorganic stabilizer particles provide a surface which covers the core polymer particle phase and provides active hydroxyl sites to react with the alkoxy groups of the alkoxy silanes. Some specific organosilane reactants that can be used in the aforementioned reaction include those represented by the following formula:

$$(RO)_n SiR^1_{(4-n)}$$

where n is from 1-3 and each R and $R^1$ are independently alkyl groups to provide $R^1$ alkyl groups covalently bonded to the surfaces of the fine inorganic particles through silicon linking groups. Preferably, each R is independently an alkyl group of from 1-3 carbons such that RO represents methoxy, ethoxy, or propoxy, more preferably 1-2 carbons, and each $R^1$ is independently an alkyl group of from 1-24 carbons such as methyl, ethyl, n-propyl, isopropyl, butyl, octyl, octadecyl and the like, more preferably 1-18 carbons, and most preferably 1-5 carbons. In further preferred embodiments, n is 3, such that the stabilized dispersed hydrophobic phase particles are treated with an alkyltrialkoxysilane to provide alkyl groups covalently bonded to the surfaces of the fine inorganic particles through silicon linking groups. In a particular preferred embodiment, the stabilized dispersed hydrophobic phase particles are treated with n-propyl trimethoxy silane. Additional hydrophobic groups which may be bonded to the surfaces of the fine inorganic particles include polydialkylsiloxanes such as PDMS, and fluorinated hydrocarbon moieties.

The modification can be performed in water by simply stirring the core polymer particles covered by the fine inorganic particles with the said alkoxy silanes for anywhere from 1-24 hours. When some ionic groups are required for proper charging as toner the functionalized particles may be contacted with either a salt such as potassium chloride or a pH 8 solution for anywhere up to 1 hour. As the hydrophobic group containing reactant reacts primarily with the exposed surfaces of the adhered fine inorganic particles positioned away from the core polymer particle (i.e., relative to the portions of the fine particles adhered to the core polymer particle), the resulting surface decorated particle will comprise a core particle phase having an outer surface; and fine inorganic particles on the outer surface of the core particle phase; wherein the fine inorganic particles have hydrophobic groups covalently bonded primarily on portions of surfaces of the fine inorganic particles positioned away from the core particle phase, in accordance with the unique particles of the present invention. Such surface decorated particles are thus distinguished from particles conventionally surface treated with inorganic particles which themselves have been pre-treated uniformly over their surfaces with a hydrophobic group containing reagent.

The limited coalescence process provides enough stabilizer particles to theoretically achieve a complete monolayer on the core polymer particles. It may sometimes be desirable to remove a fraction of these particles prior to silane treatment. Very high levels of stabilizer particles increase the melt viscosity during fusing, leading to reduced toner spread, an increase in the light scattering voids within an image, and a lowering of surface gloss. The amount of stabilizer particles removed can be controlled using pH>7. The concentration of base, temperature, and contact time can be varied to provide the desired effect. Gentler conditions are preferred when the polymer binder or other toner components are also sensitive to base. For example, polyesters can hydrolyze in the presence of base and the color and strength of pigment yellow 185 can also be negatively impacted. While a relatively high pH of about 12 or greater is typically applied in the prior art to essentially remove all inorganic stabilizer particles, treatment at pH of less than or equal to about 9 is accordingly preferred in the present invention.

Reaction between the active hydroxyl sites on external portions of surfaces of the fine inorganic particles positioned away from the core polymer particle phase and the plurality of alkoxy groups of hydrophobically functionalized alkoxy silane compounds to provide covalent bonding of hydrophobic groups to the said active hydroxyl sites can be achieved by stirring the said polymer particles at ambient temperatures in water with the alkoxy silane as described in the Examples hereinafter.

The present invention may be applied to a variety of types of surface decorated particles wherein relatively fine inorganic particles are employed to stabilize dispersed hydrophobic phase particles. While in a particular embodiment the invention is described in connection with the ultimate formation of solid surface treated particles obtainable in an evaporative or polymerization limited coalescence process, the invention in further embodiments may apply to stabilized liquid organic phases as the end surface decorated particle, such as in the formation of particulate stabilized oil-in-water Pickering emulsions.

The present invention in a particular embodiment may be applied to the preparation of toner, and other polymer binder, particles by a limited coalescence process wherein the stabilized dispersed hydrophobic phase particles are formed by dispersing an organic phase solution of a polymer dissolved in an organic solvent in an aqueous phase in the presence of the fine inorganic particles, and subsequently removing the organic solvent from the organic phase to form dispersed polymer particles. While any type of polymer that is soluble in a solvent that is immiscible with water when employing an evaporative limited coalescence process as generally described in the background of the invention discussed above, such that the size and size distribution of the resulting particles can be predetermined and controlled by the relative quantities of the particular polymer employed, the solvent, the quantity and size of the solid particulate stabilizer, and the size to which the solvent-polymer droplets are reduced by mechanical flowing and shearing using rotor-stator type colloid mills, high pressure homogenizers, agitation etc., in specific embodiments of the invention the invention is particularly useful in the formation of surface treated porous toners or surface treated small particle size toners (e.g., volume average particle size less than about 8 micrometers), which types of toners have relatively lower mass and therefore are more difficult to surface treat with dry surface treatments after formation of the toner particles.

The use of porous particles in the electrophotographic process as toner particles will reduce the toner mass in the image area. For example toner particles with 50% porosity should require only half as much mass to accomplish the same imaging results. Hence, toner particles having an elevated porosity will lower the cost per page and decrease the stack height of the print as well. The porous toner technology also enables a thinner image so as to improve the image quality, reduce curl, reduce image relief, save fusing energy and feel/look more like offset printing rather than typical EP printing.

The porous particles may include "micro," "meso," and "macro" pores which according to the International Union of Pure and Applied Chemistry are the classifications recommended for pores less than 2 nm, 2 to 50 nm, and greater than 50 nm respectively. The term porous particles will be used herein to include pores of all sizes, including open or closed pores.

Preferred processes for making porous particles which may be employed in this invention are described in US 2008/0176164 and US 2008/0176157 referenced above, the disclosures of which is incorporated by reference herein. Generally in such processes, the basic limited coalescence process is modified such that the organic phase solution of a polymer dissolved in an organic solvent further comprises a stable dispersed internal aqueous phase, wherein upon removal of the organic solvent from the organic phase porous polymer particles having an internal porosity of at least 10% are formed, preferably between 20 and 90% and most preferably between 30 and 70%, where the percent porosity represents the volume of the internal pores as a percentage of the total volume of the particle. Percent porosity may be determined by the methods described in US 2008/0176164 and US 2008/0176157. The first step in such modified process preferably involves the formation of a stable water-in-oil emulsion, including a first aqueous solution of a pore stabilizing hydrocolloid dispersed finely in a continuous phase of a binder polymer dissolved in an organic solvent. This first water phase creates the pores in the particles and the pore stabilizing compound controls the pore size and number of pores in the particle, while stabilizing the pores such that the final particle is not brittle or fractured easily.

As indicated above, the present invention is applicable to the preparation of polymeric particles by a limited coalescence process from any type of binder polymer or binder resin that is capable of being dissolved in a solvent that is immiscible with water wherein the binder itself is substantially insoluble in water. Thermoplastic polymers are typically preferred for use as toner binder polymers. Useful binder polymers include those derived from vinyl monomers, such as styrene monomers, and condensation monomers such as esters and mixtures thereof. As the binder polymer, known binder resins are useable. Concretely, these binder resins include homopolymers and copolymers such as polyesters, styrenes, e.g. styrene and chlorostyrene; monoolefins, e.g. ethylene, propylene, butylene, and isoprene; vinyl esters, e.g. vinyl acetate, vinyl propionate, vinyl benzoate, and vinyl butyrate; α-methylene aliphatic monocarboxylic acid esters, e.g. methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers, e.g. vinyl methyl ether, vinyl ethyl ether, and vinyl butyl ether; and vinyl ketones, e.g. vinyl methyl ketone, vinyl hexyl ketone, and vinyl isopropenyl ketone. Particularly desirable binder polymers/resins include polystyrene resin, polyester resin, styrene/alkyl acrylate copolymers, styrene/alkyl methacrylate copolymers, styrene/acrylonitrile copolymer, styrene/butadiene copolymer, styrene/maleic anhydride copolymer, polyethylene resin and polypropylene resin. They further include polyurethane resin, epoxy resin, silicone resin, polyamide resin, modified rosin, paraffins, and waxes. Also, especially useful are polyesters of aromatic or aliphatic dicarboxylic acids with one or more aliphatic diols, such as polyesters of isophthalic or terephthalic or fumaric acid with diols such as ethylene glycol, cyclohexane dimethanol and bisphenol adducts of ethylene or propylene oxides. Of these resins, styrene/acryl and polyester resins are particularly preferable.

In a preferred embodiment, a polyester resin is employed. The present invention is particularly useful with polyester resins that would be otherwise sensitive to relatively high pH (e.g., 12 and higher) treatment conventionally employed to remove colloidal inorganic stabilizer particles. Preferably the acid values (expressed as milligrams of potassium hydroxide per gram of resin) of the polyester resins are in the range of 2-100. The polyesters may be saturated or unsaturated.

In the practice of this invention, it is particularly advantageous to utilize resins having a viscosity in the range of 1 to 100 centipoise when measured as a 20 weight percent solution in ethyl acetate at 25° C.

Any suitable solvent that will dissolve the binder polymer and which is also immiscible with water may be used in the practice of this invention such as for example, chloromethane, dichloromethane, ethyl acetate, vinyl chloride, trichloromethane, carbon tetrachloride, ethylene chloride, trichloroethane, toluene, xylene, cyclohexanone, 2-nitropropane and the like. Particularly useful solvents in the practice of this invention are ethyl acetate and propyl acetate for the reason that they are both good solvents for many polymers while at the same time being sparingly soluble in water. Further, their volatility is such that they are readily removed from the discontinuous phase by evaporation.

Optionally, the solvent that will dissolve the binder polymer and which is immiscible with water may be a mixture of two or more water-immiscible solvents chosen from the list given above. Optionally the solvent may comprise a mixture of one or more of the above solvents and a water-immiscible nonsolvent for the binder polymer such as heptane, cyclohexane, diethylether and the like, that is added in a proportion that is insufficient to precipitate the binder polymer prior to drying and isolation.

Various additives generally present in electrostatographic toners may be added to the binder polymer prior to dissolution in the solvent, during dissolution, or after the dissolution step itself, such as colorants, charge control agents, and release agents such as waxes and lubricants.

Colorants, a pigment or dye, suitable for use in the practice of the present invention are disclosed, for example, in U.S. Reissue Pat. No. 31,072 and in U.S. Pat. Nos. 4,160,644; 4,416,965; 4,414,152 and 4,229,513. As the colorants, known colorants can be used. The colorants include, for example, carbon black, Aniline Blue, Calcoil Blue, Chrome Yellow, Ultramarine Blue, Du Pont Oil Red, Quinoline Yellow, Methylene Blue Chloride, Phthalocyanine Blue, Malachite Green Oxalate, Lamp Black, Rose Bengal, C.I. Pigment Red 48:1, C.I. Pigment Red 122, C.I. Pigment Red 57:1, C.I. Pigment Yellow 97, C.I. Pigment Yellow 12, C.I. Pigment Yellow 17, C.I. Pigment Yellow 155, C.I. Pigment Yellow 185, C.I. Pigment Blue 15:1 and C.I. Pigment Blue 15:3. Colorants can generally be employed in the range of from about 1 to about 90 weight percent on a total toner powder weight basis, and preferably in the range of about 2 to about 20 weight percent, and most preferably from 4 to 15 weight percent in the practice of this invention. When the colorant content is 4% or more by weight, a sufficient coloring power can be obtained, and when it is 15% or less by weight, good transparency can be obtained. Mixtures of colorants can also be used. Colorants in any form such as dry powder, its aqueous or oil dispersions or wet cake can be used in the present invention. Colorant milled by any methods like media-mill or ball-mill can be used as well. The colorant may be incorporated in the oil phase, or in the first aqueous phase when making porous particles by a water-in-oil-in-water double emulsion process. The invention in a particular embodiment is especially useful when employing pH-sensitive pigments such as PY 185, which other wise may wash-out when employing relatively high pH (e.g., 12 and higher) treatment conventionally employed to remove colloidal inorganic stabilizer particles.

The release agents which may be preferably used herein are waxes. Concretely, the releasing agents usable herein include low-molecular weight polyolefins such as polyethylene, polypropylene and polybutene; silicone resins which can be softened by heating; fatty acid amides such as oleamide, erucamide, ricinoleamide and stearamide; vegetable waxes such as carnauba wax, rice wax, candelilla wax, Japan wax and jojoba oil; animal waxes such as bees wax; mineral and petroleum waxes such as montan wax, ozocerite, ceresine, paraffin wax, microcrystalline wax and Fischer-Tropsch wax; and modified products thereof. When a wax containing a wax ester having a high polarity, such as carnauba wax or candelilla wax, is used as the releasing agent, the amount of the wax exposed to the toner particle surface is inclined to be large. On the contrary, when a wax having a low polarity such as polyethylene wax or paraffin wax is used, the amount of the wax exposed to the toner particle surface is inclined to be small.

Irrespective of the amount of the wax inclined to be exposed to the toner particle surface, waxes having a melting point in the range of 30 to 150° C. are preferred and those having a melting point in the range of 40 to 140° C. are more preferred.

The wax is, for example, 0.1 to 20% by mass, and preferably 0.5 to 15% by mass, based on the toner.

The term "charge control" refers to a propensity of a toner addendum to modify the triboelectric charging properties of the resulting toner. A very wide variety of charge control agents for positive charging toners are available. A large, but lesser number of charge control agents for negative charging toners, is also available. Suitable charge control agents are disclosed, for example, in U.S. Pat. Nos. 3,893,935; 4,079,014; 4,323,634 and 4,394,430 and British Patents 1,501,065 and 1,420.839. Charge control agents are generally employed in small quantities such as, from about 0.1 to about 5 weight percent based upon the weight of the toner. Additional charge control agents which are useful are described in U.S. Pat. Nos. 4,624,907; 4,814,250; 4,840,864; 4,834,920; 4,683,188 and 4,780,553. Mixtures of charge control agents can also be used.

In accordance with the limited coalescence process which may be employed in the formation of particles of the present invention, an oil-in-water emulsion is formed by dispersing the organic phase components in an aqueous phase containing inorganic particle stabilizer particles such as colloidal silica as described in U.S. Pat. Nos. 4,833,060; 4,965,131; 2,934,530; 3,615,972; 2,932,629 and 4,314,932, the disclosures of which are hereby incorporated by reference. The pH of the aqueous phase is generally between 4 and 7 when using silica as the colloidal stabilizer.

Upon removal of the solvent that is used to dissolve the binder polymer, a suspension of uniform polymer particles in aqueous solution is obtained. The rate, temperature and pressure during drying will also impact the final particle size and surface morphology. Solvent removal apparatus such as a rotary evaporator or a flash evaporator may be used in the practice of the method. The polymer particles may then be isolated, after removing the solvent, by filtration, followed by drying in an oven at 40° C. which also removes any water remaining in the pores from the first water phase when making porous particles by the double emulsion process.

Isolation of porous particles, made by the multiple emulsion process, generally involves filtration of the particles, contact with base at pH>12, e.g., potassium hydroxide, to remove the fine colloidal silica stabilizer on the surface of the particles, followed by filtration to remove the external water phase and washing until the conductivity of the external water phase is less than 100 micro Seimens/cm, preferably less than 10 micro Seimens/cm. This is followed by another filtration to isolate the particles. Such filtrations have been discovered to be very slow due to the presence of water in the pores, as during filtration hydraulic pressure builds up in the filter cake, especially when the ionic strength in the external water phase is lower than in the pores. The problem is magnified during pressure filtration (e.g., wherein greater than atmospheric pressure is applied to the dispersion of porous particles during filtration) or vacuum filtration (e.g., wherein lower than atmospheric pressure is applied on a side of the filter opposite to the dispersion of porous particles during filtration), resulting in very slow filtration. The problem becomes especially evident when the ionic strength of the external water phase is low, e.g., less than 100 microSeimens/cm, and in particular less than about 10 microSeimens/cm. Conductivity measures the ability of a material to carry an electric charge through it. Since ions present in aqueous solution facilitate the conductance of electric current, the conductivity of the solution is proportional to its ionic strength. This low conductivity of the external water phase after repeated filtrations and washing of the particles causes water to rush back into the pores, creating hydraulic pressure build up in the pores and subsequently between the particles during filtration under pressure as is often practiced in manufacturing. In the practice of this invention, it has been discovered that such manufacturing problems can be minimized, by eliminating the silica removal step and instead modifying the surface of the silica with hydrophobic groups using the silane treatment described by this invention.

In other embodiments of formation of decorated particles of the present invention, a dispersion of porous polymer particles in an external aqueous phase may be formed where a pore stabilizing hydrocolloid may be emulsified in an organic solution containing a mixture of water-immiscible polymerizable monomers, a polymerization initiator and optionally a colorant and a charge control agent to form the first water in oil emulsion. The resulting emulsion may then be dispersed in water containing stabilizer to form a water-in-oil-in-water emulsion through the limited coalescence process. The monomers in the emulsified mixture are polymerized to form droplets of polymer particles, preferably through the application of heat or radiation. Any remaining organic solution may be evaporated, and the resulting suspension polymerized particles may be isolated and dried as described earlier to yield porous particles. In addition, the mixture of water-immiscible polymerizable monomers can contain the binder polymers listed previously.

The shape of toner particles has a bearing on the electrostatic toner transfer and cleaning properties. Thus, for example, the transfer and cleaning efficiency of toner particles have been found to improve as the sphericity of the particles are reduced. A number of procedures to control the shape of toner particles are know in the art. In the practice of this invention, additives may be employed in the water phase or in the oil phase if necessary. The additives may be added after or prior to forming the oil-in-water emulsion. In either case the interfacial tension is modified as the solvent is removed resulting in a reduction in sphericity of the particles. U.S. Pat. No. 5,283,151 describes the use of carnauba wax to achieve a reduction in sphericity of the particles. US 2008/0145779 describes the use of certain metal carbamates that are useful to control sphericity and US 2008/0145780 describes the use of specific salts to control sphericity. US 2007/0298346 describes the use of quaternary ammonium tetraphenylborate salts to control sphericity. The disclosures of these patents and applications are incorporated by reference herein.

The polymer particles initially prepared by the LC process, whether porous or nonporous are those known to be useful in electrostatographic toners and are formulated with carrier particles to make useful developers for electrophotography.

U.S. Pat. Nos. 4,546,060 and 4,473,029, the disclosures of which are incorporated herein by reference, describe that the use of "hard" magnetic materials as carrier particles increases the speed of development dramatically when compared with carrier particles made of "soft" magnetic particles. The preferred ferrite materials disclosed in these patents include barium, strontium and lead ferrites having the formula $MO_6Fe_2O_3$ wherein M is barium, strontium or lead. However, magnetic carriers useful in the invention can include soft ferrites, hard ferrites, magnetites, sponge iron, etc. In addition, the magnetic carrier ferrite particles can be coated with a polymer such as mixtures polyvinylidenefluoride and polymethylmethacrylate or silicone resin type materials. Preferably, the toner is present in an amount of about 2 to about 20 percent by weight of the developer and preferably between 5 and 12 weight percent. Preferably, the average particle size ratio of carrier to toner particles is from about 15:1 to about 1:1. However, carrier-to-toner average particle size ratios of as high as about 50:1 can be useful. Preferably, the volume average particle size of the carrier particles can range from about 5 to about 50 microns.

Toner and developer compositions of this invention can be used in a variety of ways to develop electrostatic charge patterns or latent images. Such developable charge patterns can be prepared by a number of means and be carried for example, on a light sensitive photoconductive element or a non-light-sensitive dielectric-surfaced element such as an insulator-coated conductive sheet. One suitable development technique involves cascading the developer composition across the electrostatic charge pattern, while another technique involves applying toner particles from a magnetic brush. This latter technique involves the use of a magnetically attractable carrier vehicle in forming the developer composition. After image wise deposition of the toner particles, the image can be fixed, e.g., by heating the toner to cause it to fuse to the substrate carrying the toner. If desired, the unfused image can be transferred to a receiver such as a blank sheet of copy paper and then fused to form a permanent image. Toners used in color electrographic printers are typically polymeric particles of approximately 5 to 8 microns volume average particle size, containing dispersed colorants, charge control agents, waxes, and other addenda.

The terms "surface treatment" or "external additive" are typically used to describe such a toner formulation ingredient that is a dry fine particulate which is added after the core toner particle has been prepared. In a particular embodiment, it is the purpose of this invention to avoid the use of these additives. However, they may be optionally used for additional surface force and electrostatographic charge control characteristics. The most commonly used dry surface treatment agent on toner is fumed silica, especially hydrophobic silica. Fumed silica is available in a range of primary particle sizes, which is typically measured rather as the specific surface area by the BET nitrogen adsorption method. The surface area equivalent size is size divided by the product of the surface area and the density. The smallest available fumed silica materials have a BET surface area of about 400 $m^2/g$ corresponding to silica particle of about 7 nm in size, while the largest available materials have a BET surface area of about 50 $m^2/g$. As a general rule, the smaller the primary particle size of the silica (the higher the BET surface area), the more free-flowing will be the resulting surface treated toner for a given weight percent of silica added.

An organic coating is typically applied to the fumed silica in order to cover surface silanol groups in order to render the silica hydrophobic and control triboelectric charge. Common coatings include silicone fluid also known as polydimethylsiloxane (PDMS), hexamethyldisilazane (HMDZ), and dimethydichlorolsilane (DMDCS) and other alkyl silanes. Such materials are available commercially from vendors including Evonik Degussa Corporation, Cabot Corporation and Wacker. Aerosil RY200L2 and RX-50, both available from Evonik Degussa Corporation, are PDMS and HMDZ treated silicas having BET surface areas of 200 and 50 $m^2/g$. The reported particle sizes are 12 and 40 nanometers. The RX-50 particle size is similar to the particle size of the limited coalescence stabilizer used in this study, NALCO 1060, at 60 nanometers. Table 1 shows the typical sizes of fumed silicas and the colloidal silica used in the present invention.

TABLE 1

| Silica | Vendor | Silica Type | Surface Area ($m^2/g$) | Avg. Size (nm) | Surface Modifier |
|---|---|---|---|---|---|
| RY200L2 | Evonik Degussa Corp | Hydrophobic Fumed Silica | 200 | 12 | PDMS |
| RX50 | Evonik Degussa Corp | Hydrophobic Fumed Silica | 50 | 40 | HMDZ |
| Nalco 1060 | Nalco Corp | Colloidal Silica | 40-60 | 50-70 | None |

The following examples are intended to further illustrate, but not to limit, the invention.

The Kao Binder E, a polyester resin, used in the examples below was obtained from Kao Specialties Americas LLC a part of Kao Corporation, Japan. Carboxymethyl cellulose (CMC) molecular weight approximately 250K as the sodium salt was obtained from Acros Organics. NALCO $1060^T$, a colloidal silica, was obtained from Nalco Chemical Co. as a 50 weight percent dispersion. The wax used in the examples was the ester wax WE-3 from NOF Corporation. The wax dispersants, Lutensol TDA6 (ethoxylated tridecyl alcohol, 6 moles EO, HLB 11) and Lutensol A65N (ethoxylated (amyl alcohol, 6.5 moles BO, HLB 12) were purchased from BASF. Poly(ethyl oxazoline) MW 50K was obtained from Aldrich. PY 185 (Paliotol Gelb D1155) was obtained from BASF and PY 155 (Inkjet yellow 4GVP) was obtained from Clariant. Solsperse 35K and 22K were obtained from Lubrizol.

The particle size distribution was characterized by either a Sysmex FPIA3000 distributed by Malvern Instruments, Ltd or a Coulter Particle Analyzer. The particle size was characterized as either the median or the mode (volume) from the respective instruments.

The level of porosity of the particles of the present invention was measured using a combination of methods. To accurately determine the extent of porosity in the particles of the present invention a combination of conventional diameter sizing and time-of-flight methods was used. Conventional sizing methods include total volume displacement methods such as Coulter particle sizers or image based methods such as the Sysmex FPIA3000 system. The time-of-flight method used to determine the extent of porosity of the particles in the present invention includes the Aerosizer particle measuring system. The Aerosizer measures particle sizes by their time-of-flight in a controlled environment. This time of flight depends critically on the density of the material. If the material measured with the Aerosizer has a lower density due to porosity or a higher density due, for example, to the presence of fillers, then the calculated diameter distribution will be shifted artificially low or high respectively. Independent measurements of the true particle size distribution via alternate methods (e.g. Coulter or Sysmex) can then be used to fit the Aerosizer data with particle density as the adjustable parameter. The method of determining the extent of particle porosity of the particles of the present invention is as follows. The outside diameter particle size distribution is first measured using either the Coulter or Sysmex particle measurement systems. The mode of the volume diameter distribution is chosen as the value to match with the Aerosizer volume distribution. The same particle distribution is measured with the Aerosizer and the apparent density of the particles is adjusted until the mode (D50%) of the two distributions matches. The ratio of the calculated and solid particle densities is taken to be the extent of porosity of the particles (1-Aerosizer density/density of solid particle). The calculated porosity values generally have uncertainties of +/−10%.

X-ray fluorescence (XRF) or inductively coupled plasma atomic emission spectroscopy (ICP-AES) was used to determine the level of fine silica particles associated with the polymer particles. The concentrations are reported in terms of % silicon in the sample.

The dry powder flow of the toner particles was quantified through a bulk volume fraction determination. First the bulk density was measured using a vibratory funnel flow device. The toner sample was allowed to free flow through the funnel and overflow into a volumetric calibrated cup. The excess material was skived off the top of the cup. The bulk density is calculated as the toner mass in the cup divided by the cup volume. A suitable device for measuring bulk density is the Powder Tester manufactured by Hosokawa Micron Corporation but any similar vibratory funnel flow device can be used. Prior to adding the material to the funnel it was whisked to aerate the sample. The toner bulk volume fraction is a measure of the interstitial volume between toner particles and is calculated using the following equation:

$$\text{Bulk Volume Fraction} = \frac{\rho_{BD}}{\rho_t(1-\phi)}$$

where $\rho_{BD}$ is the bulk density and $\rho_1$ is the weight averaged density of the solid toner including its components and any residual silica. $\phi$ is the porosity of the toner. Without any residual silica the density of the solid toner is approximately 1.2 /cc. The density of pure residual silica ($SiO_2$) is 2.2 /cc.

A higher toner bulk volume fraction indicates that the powder is more free-flowing and that the toner particles can flow freely past each other and settle into a more densely packed state. A toner with less fine inorganic particles on the surface leads to core polymer particles adhering to each other resulting in poor powder flow and low toner bulk volume fraction.

Particles P1, Check 1

Toners made according to this invention exhibit good charging properties and show good powder flow. To illustrate this, a batch of porous toner particles P1 was made containing 8 wt % PY 185 and, colloidal silica on the surface using the following general procedure:

To a 3 wt % aqueous solution of CMC molecular weight 250K was added 127.19 g of a wax dispersion in water containing 18.9 wt % of WE-3 and 2.83 wt % of a 1:1 mixture of Lutensol TDA6 and Lutensol A65N dispersants, along with 61.89 g of additional water. This was dispersed for two minutes at 9300 RPM using a Silverson L4R homogenizer fitted with an Emulsor Screen, into 382.61 grams of ethyl acetate along with 943.8 grams of a 25.1 wt % Kao E polymer resin solution in ethyl acetate and 168.9 grams of a dispersion containing 14.21 wt % PY 185 and 4.26 wt % of a mixture of Solsperse 35K+22K (25+5) as dispersants for the colorant. The resultant water-in-oil emulsion was further homogenized using a Microfluidizer Model #110T from Microfluidics at a pressure of 9000 psi. A 1600 g aliquot of the resultant very fine water-in-oil emulsion was dispersed, using the Silverson homogenizer fitted with the General-Purpose Disintegrating Head for two minutes at 2000 RPM, in 2666.7 g of the second water phase comprising a pH 4 buffer (200 mM citric acid/phosphate) and 131.2 g of NALCO 1060, followed by homogenization in an orifice disperser at 1000 psi to form a water-in-oil-in-water double emulsion. This emulsion was diluted with an equal weight of water containing a 0.03 wt % solution of PEOX. The ethyl acetate was evaporated using a Heidolph Laborata rotary evaporator at 40° C. under reduced pressure. The resulting suspension of beads was filtered through a glass fitted funnel, washed with distilled water several times until the conductivity of the filtrate was less than 20 μS and then redispersed in distilled water to yield a suspension of P1 in water. The Coulter volume median particle size was 6.7 μm and the Aerosizer based porosity was 36%. These particles comprised a core particle phase having an outer surface and fine inorganic particles on the outer surface of the core particle phase. The fine inorganic particles provide a plurality of active hydroxyl groups on external portions of surfaces of the fine colloidal silica particles positioned away from the core particle phase for reaction with a alkoxy silanes derivatized with hydrophobic groups.

A sample of P1 particles was isolated and dried under vacuum at 35 C. This was treated as Check 1 for the invention. The particles were found to contain 8.8% silicon by ICP. The toner charge (Q/M) is shown in Table 2. The sample exhibited a lot of dust after triboelectrification.

EXAMPLE 1

Invention

To 500 g of suspension of P1 at 23.3 wt % of particles, 10.75 g of n-propyl trimethoxysilane (MW 164.3) was added and the mixture was covered and stirred for 17 his after which the pH was raised to pH=8.0 with 1N KOH and held there with stirring for 1 hr. The particles were isolated using a sintered glass funnel, washed with distilled water until the conductivity of the filtrate was less than 20 μS. There was a very light yellow color in the filtrate. The particles were dried as in the case of the P1 under reduced pressure and comprised n-propyl derivatized silane moieties covalently bonded primarily to the external portions of surfaces of the fine colloidal silica particles positioned away from the core particle. The particles were found to contain 4.7% silicon by ICP. The loss of silicon represents removal of some of the colloidal silica particles on the surface of the core particle phase. The toner charge is shown in Table 2. The sample showed little propensity for generating dust after triboelectrification.

Check 2

A 150 g of the suspension of P1 as in Check 1 was diluted to 500 g with water the pH raised to 8.0 with 1N KOH and stirred for 1 hr. There was a light orange yellow color in the filtrate indicating the tendency of PY 185 to wash out at higher pH. The particles were washed and isolated as in Example 1. The particles were found to contain 4.7% silicon by ICP. The toner charge is shown in Table 2. The sample showed considerable dust after triboelectrification.

Check 3

A 150 g of the suspension of P1 as in Check 1 was diluted to 500 g with water the pH raised to 12.5 with 1N KOH and stirred for 1 hr to remove all the colloidal silica on the surface of the core particle phase. The filtrate showed a strong orange color indicating dissolution of PY 185. The particles were found to contain 0.25% silicon by ICP. The toner charge is shown in Table 2. The sample exhibited dusting after triboelectrification.

Each of the aforementioned toner particles was converted to developers to measure their charge to mass. Small amounts of toner and carrier were placed in a 25 ml vial to achieve the desired 6% ratio of toner to carrier. The carrier used was a 23 μm strontium hard ferrite particle that had been coated with 0.25% polyvinylidine fluoride and 1% polymethylmethacrylate. 1 gram of developer was then placed in a "wrist" shaker apparatus where the developer was thrown back and forth against the top and bottom of the vial for 2 minutes. 0.1 grams of developer was then sampled and the charge per mass measured. The vial was then cradled on top of 2 inch stationary roll with a 12 pole magnetic core rotating at 2000 rpm for 8 minutes and the Q/M again measured. These are known as the 2 and 10 minute Q/M.

Where toner charge in a developer is indicated, usually as μC/g of toner particles (micro coulombs per gram), the charge was determined by a technique referred to as the "MECCA" method, wherein the apparatus consists of two parallel metal plates separated by insulating posts about 1 cm high. An AC electromagnet is located beneath the lower plate to provide magnetic agitation, while a DC electric potential of about 2500 volts can be applied across the plates. A sample of about 0.1 gram of developer is weighed and placed on the lower plate. Next, both the electric and magnetic fields are applied for 40 seconds. The toner is separated from the carrier by the combined agitation and electric field and is transported to the upper plate by the electric field. The charge on the toner collected by the top plate is measured in microcoulombs by an electrometer, and the weight of toner is determined. The registered charge is divided by the weight of the plated toner to obtain the charge per mass of toner.

A quantitative measure of the degree of silica attachment or tacking (tacked silica in Tables 2-4) to the toner surface was obtained by assessing the transfer of the free silica from the toner to the surface of a probe (carrier) that is similar in nature to the core toner particles. If the silica is completely free, then after mixing it will be distributed uniformly over both the toner particles and the probe surfaces when the probe surface area and toner particle surface areas match.

The probe surface used was a 23 μm strontium hard ferrite carrier particle that had been coated with 1.25% polymethylmethacrylate. The following equation was used to find the toner concentration, Tc, where the toner surface area matched the carrier surface area.

$$\text{Solving for } Tc: \frac{6\left(\frac{Tc}{100}\right)}{\rho_t(1-\phi)d_t} = \frac{6\left(1-\frac{Tc}{100}\right)}{\rho_c d_c}$$

$$Tc = \frac{100\alpha}{(1+\alpha)} \text{ where } \alpha = \frac{\rho_t(1-\phi)d_t}{\rho_c d_c}$$

where ρ is the density and d is median volume particle. ϕ is the toner porosity. The density of the carrier particles was 5.0 g/cc.

4 grams of developer was built at a toner concentration where the toner surface area matched the probe carrier surface area and placed in a "wrist" shaker apparatus where the developer was thrown back and forth against the top and bottom of the vial for 2 minutes. The toner was completely stripped from the carrier using a Mecca device running at 2500V for 40 seconds. 0.2 grams of carrier was obtained this way and submitted for ICP to quantify the amount of transferred silica. The amount of tacked silica is equal to amount of silica per gram of probe carrier divided by half the amount initially present in the developer.

$$\%\text{ tacked silica} = 1 - \frac{Si_{probe}}{0.5Si_{toner}\left(\frac{Tc}{100}\right)}$$

Table 2 shows the results of functionalizing the fine colloidal silica particles on the outer surface of the core particle phase through covalent bonding with hydrophobic silanes. Although higher pH treatment can be used as in Checks 2 and 3, to lower the overall level of residual colloidal silica on the surface and a consequent increase in Q/M, the resulting increase in toner cohesiveness as measured by the toner bulk volume fraction in the powder flow test as described before, makes this inferior to surface treatment with the silane. A comparison of Check 2 with the inventive Example 1 shows that hydrophobically functionalized silane treatment increases Q/M and charging rate while maintaining the benefits of good powder flow.

TABLE 2

| Sample ID | Surface silica treatment | Si level in sample (%) | Q/M μC/g 2' | Q/M μC/g 10' | 2'/10' Q/M Charging rate | Toner bulk volume fraction | % Tacked Si |
|---|---|---|---|---|---|---|---|
| Check 1 comparative | None | 8.8 | −5 | −25 | 19% | 0.37 | 96% |
| Check 2 comparative | pH 8 | 4.7 | −7 | −35 | 19% | 0.29 | 97% |
| Check 3 | pH 12 | 0.25 | −57 | −93 | 61% | 0.19 | |

TABLE 2-continued

| Sample ID | Surface silica treatment | Si level in sample (%) | Q/M μC/g 2' | Q/M μC/g 10' | 2'/10' Q/M Charging rate | Toner bulk volume fraction | % Tacked Si |
|---|---|---|---|---|---|---|---|
| comparative Example 1 inventive | n-Propyl trimethoxy silane/pH 8 | 4.7 | −61 | −99 | 62% | 0.33 | 89% |

The above results clearly demonstrate that the toner charge, powder flow as measured by toner bulk volume fraction and charging rate are consistently higher when the toner particles have the hydrophobic groups attached to the surface of the fine colloidal silica particles according to the practice of this invention. Also the silica is substantially tacked to the toner surface. FIG. 1 is a scanning electron microscope (SEM) image of the particles from Example 1 showing core polymer particles that have a surface layer of small inorganic particles that have hydrophobic groups covalently bonded primarily on the external portions of surfaces of the fine inorganic particles positioned away from the core particle phase.

The toners described in Table 2 were subject to additional external surface treatment. Toners were made by surface treating the porous core toners with 1.5% of RY200L2 and 4.0% RX50.12 g of toner and the appropriate amount of silica were mixed in a Waring Laboratory Blender for 30 seconds at 4500 RPM followed by 60 s at 17,400 RPM and 30 s at 19,500 RPM. Table 3 shows the results of adding RY200L2 and RX50 fumed silica at 1.5 and 4.0 wt % respectively with respect to toner, to the comparative and inventive examples of Table 2. Although toner bulk volume fractions, Q/Ms and charging rates increased for all the samples, the inventive Example 2 has the best combination of these attributes. In all cases the percent tacked silica decreased showing the difficulty of firmly attaching silica using dry surface treatment. Whereas as shown in Table 2, the percent tacked silica is higher in all cases due to the fact that the fine colloidal silica particles are more strongly bound to the surface of the core polymer particles.

TABLE 3

| Sample ID | Starting sample | Q/M μC/g 2' | Q/M μC/g 10' | 2'/10' Q/M Charging rate | Toner bulk volume fraction | % Tacked Si |
|---|---|---|---|---|---|---|
| Check 4 comparative | Check 1 | −28 | −37 | 76% | 0.45 | 82% |
| Check 5 comparative | Check 2 | −37 | −57 | 65% | 0.36 | 80% |
| Check 6 comparative | Check 3 | −89 | −104 | 86% | 0.27 | 72% |
| Example 2 inventive | Example 1 | −99 | −118 | 84% | 0.40 | 63% |

The inventive toner of Example 1 was also subject to another external surface treatment as described above except for using only 1.5% of RY200L2, or only 4.0% RX50. Compared to Example 1 in Table 2, Q/Ms and charging rates increased in Examples 3 and 4 as shown in Table 4. These examples demonstrate the ability to use both predispersed non-aggregated hydrophobically treated silica stabilizer particles and dry surface treatment additives to further control the surface force and charging properties of toners. It should be recognized again that none of the toners that used the addition of dry surface treatment could achieve the ideal level of tacked silica of Example 1.

TABLE 4

| Sample ID | Starting sample | Q/M μC/g 2' | Q/M μC/g 10' | 2'/10' Q/M Charging rate | Toner bulk volume fraction | % Tacked Si |
|---|---|---|---|---|---|---|
| Example 3 inventive | Example 1 | −88 | −127 | 69% | 0.39 | 76% |
| Example 4 inventive | Example 1 | −79 | −84 | 94% | 0.38 | 67% |

P2 Check 7 Comparative

Another batch of porous toner particles P2 was made containing 8 wt % PY 185 and colloidal silica on the surface following the procedure used to make P1 except that the dispersant for the pigment was Solsperse 35K alone at 30 wt % of the pigment and the wax dispersion was made with Tergitol TMN-6. The ethyl acetate also contained a charge control agent 1.5 wt % of the toner. The particle size was 11.52 μm (mode) Sysmex FPIA-3000. The level of silica by XRF was 8.04 wt %. The measured charge/mass of the toner particle was: 2'=−4 μC/g, 10'=−15 μC/g. The sample showed a lot of dust after tribocharging against the carrier.

EXAMPLE 5

A sample of P2 (100 g) was treated with 1.98 g n-propyl trimethoxysilane as in Example 1 except that the pH was not adjusted to 8 after 17 hours. Instead 10 ml of a 0.02M potassium chloride solution in water was added and stirred for 4 hrs. The silane modified particles were isolated as before. The level of silica by XRF was 8.88 wt %. The measured charge/mass of the toner particles was: 2'=−18 μC/g, 10'=−125 μC/g. The sample exhibited almost no dusting.

EXAMPLE 6

This was carried out as in Example 5 except that a smaller amount of silane (0.8 g) was used to derivatize the surface fine silica particles. The level of silica by XRF was 8.60 wt %. The measured charge/mass of the toner particles was: 2'=−13 μC/g, 10'=−60 μC/g. The sample exhibited almost no dusting. Examples 5 and 6 show that attaching hydrophobic groups to the surface of the fine colloidal silica particles according to the practice of this invention greatly improved the tribocharging of the particles and eliminated dusting after triboelectrification compared to the Check 7.

EXAMPLE 7

A sample of P2 (100 g) was treated with 4.52 g of oetadecyltrimethoxysilane (MW-374.69) instead of n-propyl trimethoxysilane as in Example 5. Further the sample was not contacted with potassium chloride prior to isolation as in Example 3. The filtrate is faint pale yellow. The measured charge/mass of the toner particles was: 2'=−3 μC/g, 10'=−10 μC/g. The sample showed no dusting after triboelectrification compared to Check 7 although the charge was apparently lower. This shows that the surface was indeed modified with hydrophobic octadecyl groups covering up the free hydroxyl groups. The charge can be raised by contacting it with KCl if necessary.

P3 Check 8 Comparative

Another batch of porous toner particles P3 was made containing 12 wt % PY 155 and colloidal silica on the surface following the procedure used to make P1 except that the dispersant for the pigment was Solsperse 35K alone at 20 wt % of the pigment and the wax dispersion was as in P1. The ethyl acetate also contained a charge control agent 1.5 wt % of the toner. The particle size was 7.0 μm (mode) Sysmex FPIA-3000. The measured charge/mass of the toner particle was: 2'=−2 μC/g, 10'=−7 μC/g. The sample showed a lot of dust after tribocharging against the carrier.

EXAMPLE 8

A sample of P2 (100 g) was treated with 3.20 g n-propyl trimethoxysilane as in Example 1. The silane modified particles were isolated as before. The level of silica by XRF was 8.88 wt %. The measured charge/mass of the toner particles was: 2'=−15 μC/g, 10'=−51 μC/g. The sample exhibited almost no dusting. This shows that compared to Check 8 the sample showed very good charging and no dusting in accordance with the scope of the invention.

The invention has been described in detail with particular reference to certain preferred embodiments thereof, but it should be appreciated that variations and modifications can be effected within the spirit and scope of the invention.

The invention claimed is:

1. A surface decorated electrophotographic toner particle comprising:

a core particle phase having a first outer surface; and fine inorganic particles each having a second surface with a first portion of the second surface facing the core particle and a second portion of the second surface positioned away from the core particle;

wherein the first portion of the second surface of the fine inorganic particles are hydrogen bonded to the first outer surface of the core particle phase and the second portion of the second surface of the fine inorganic particles have hydrophobic groups covalently bonded to the second portion of the second surfaces of the fine inorganic particles positioned away from the core particle phase.

2. A surface decorated electrophotographic toner particle according to claim 1, wherein the core particle phase comprises a thermoplastic polymer.

3. A surface decorated electrophotographic toner particle according to claim 1, wherein the fine inorganic particles comprise metal oxide or silica particles.

4. A surface decorated electrophotographic toner particle according to claim 1, wherein the fine inorganic particles comprise silica.

5. A surface decorated electrophotographic toner particle according to claim 1, wherein the fine inorganic particles have hydrocarbon groups covalently bonded primarily to the second portion of the second surface of the fine inorganic particles positioned away from the core particle phase through silicon linking groups.

6. A surface decorated electrophotographic toner particle according to claim 1, wherein the toner particle has a volume average particle diameter of less than 8 micrometers.

7. A surface decorated electrophotographic toner particle according to claim 1, wherein the toner particle comprises a porous core particle phase having an internal porosity of at least 10 volume percent.

8. A surface decorated electrophotographic toner particle according to claim 1, wherein the toner particle comprises a core particle phase comprising a polyester binder.

9. A surface decorated electrophotographic toner particle according to claim 1, wherein the toner particle comprises PY185.

10. A surface decorated electrophotographic toner particle according to claim 1, wherein the toner particle comprises a charge control agent.

11. A surface decorated electrophotographic toner particle according to claim 1, wherein the fine inorganic particles comprise silica and have hydrocarbon groups covalently bonded primarily to the second portion of the second surface of the fine inorganic particles positioned away from the core particle phase through silicon linking groups.

12. A surface decorated electrophotographic toner particle according to claim 11, wherein the hydrocarbon groups comprise alkyl group of from 1-24 carbons.

13. A surface decorated electrophotographic toner particle according to claim 11, wherein the hydrocarbon groups comprise alkyl groups of from 1-18carbons.

14. A surface decorated electrophotographic toner particle according to claim 1, wherein the core particle phase comprises an oil phase.

* * * * *